US009089877B2

(12) United States Patent
McGrath, Jr.

(10) Patent No.: US 9,089,877 B2
(45) Date of Patent: Jul. 28, 2015

(54) BACKING SCREEN PANELS FOR VIBRATING SCREEN SEPARATOR

(71) Applicant: Michael McGrath, Jr., Vineland, NJ (US)

(72) Inventor: Michael McGrath, Jr., Vineland, NJ (US)

( * ) Notice: Subject to any disclaimer, the term of this patent is extended or adjusted under 35 U.S.C. 154(b) by 215 days.

(21) Appl. No.: 13/835,391

(22) Filed: Mar. 15, 2013

(65) Prior Publication Data

US 2014/0262975 A1 Sep. 18, 2014

(51) Int. Cl.
*B07B 1/00* (2006.01)
*B07B 1/46* (2006.01)

(52) U.S. Cl.
CPC ..... *B07B 1/4663* (2013.01); *B07B 1/469* (2013.01); *B07B 1/4672* (2013.01)

(58) Field of Classification Search
CPC ..... B07B 1/28; B07B 1/42; B07B 1/46
USPC ..... 209/240, 311, 315, 391, 397
See application file for complete search history.

(56) References Cited

U.S. PATENT DOCUMENTS

| | | | | |
|---|---|---|---|---|
| 5,199,574 | A | 4/1993 | Hollyfield, Jr. et al. | |
| 5,819,951 | A * | 10/1998 | Sultanovich et al. | 209/313 |
| 6,079,568 | A * | 6/2000 | Loshe | 209/311 |
| 7,216,768 | B2 * | 5/2007 | Fisher et al. | 209/395 |
| 7,703,612 | B2 * | 4/2010 | Browne et al. | 209/311 |
| 2006/0180509 | A1 * | 8/2006 | Burnett et al. | 209/405 |
| 2008/0093268 | A1 * | 4/2008 | Hukki et al. | 209/399 |

* cited by examiner

*Primary Examiner* — Terrell Matthews
(74) *Attorney, Agent, or Firm* — Duane Morris LLP

(57) ABSTRACT

A vibrating screen separator machine including a frame bounding a first screening assembly, the first screening assembly forming a first sifting plane. The first screening assembly comprises a mesh screen and a planar backing panel proximate the mesh screen, the backing panel having a plurality of perforations. The screen separator also includes a material input slot on the frame and an un-sifted material output slot and a sifted material output slot on the frame where material travels from the material input slot into the screening assembly and where un-sifted material exits the frame through the un-sifted material output slot and sifted material exits the frame through the first sifted material output slot. The screen separator also includes a vibration mechanism supported by the frame and connected to the screening assembly, the vibration mechanism imparting vibrational energy to the screening assembly to sift material passing through the screening assembly.

19 Claims, 12 Drawing Sheets

BACKING SCREEN PANELS FOR VIBRATING SCREEN SEPARATOR

BACKGROUND

The present subject matter is generally directed to vibrating screen separator systems. In a conventional screen separator, an elongated, box-like like frame of upright rigid characteristics may be inclined over a supporting surface, and a screen captivated within the frame may be vigorously shaken as material passes over the screen. Material having a predetermined size drops through the screen for conveyance to alternative separators or product bins and the like. Exemplary vibrators include pneumatic, hydraulic, and rotary types vibration mechanisms.

Screening effectiveness of a vibrating wire screen is generally a function of gravity and the movement of material relative to the wire screen. For example, too little movement of the particles may allow material to wedge in the wire cloth, and too much movement may bounce the particles excessively and reduce screening capacity while increasing dust level. Generally, conveying capacity of a material on a vibrating wire screen is a function of slope, amplitude, frequency, load, and flow characteristics of the material. An optimum flow, amplitude, frequency, and slope relation would be one that loads the wire cloth with the maximum amount of material but does not impede the free movement of the material. An increase in the slope of the machine, an increase in the amplitude or frequency of vibration, and/or a reduction of the load may increase free movement of a material through an exemplary machine.

Due to the input of relatively large amounts of vibrational energy in conventional screen separator machines, however, damage to the screening cloth, particularly along the mounting edges and at the mesh cloth and backing wire screen interface occurs. Additionally, as more energy is inputted to an exemplary vibrating system, the greater the possibility of fatigue and destruction to the screen may be incurred. For example, conventional vibrating wire screening machines employ a screening mesh cloth with a backing wire screen adjacent thereto. The screening mesh cloth typically possesses a finer mesh than the backing wire screen. At every point in the mesh cloth to wire screen interface where there is a cross wire in the weave, a knuckling effect may be imparted on the adjacent mesh cloth. Subsequent vibration of the screening machine may thus prematurely wear out the mesh cloth and/or wire screen.

It is also known that vibrating wire screening machines exhibit varying amplitude rates across the face of the wire cloth (i.e., loops and nodes), and the position of these loops and nodes will vary with the type of wire and wire tension. It is, however, difficult to obtain uniform distribution of force energy upon the surface of the screen, and failure to properly distribute the energy vibrations may result in regions of high vibration separated from regions of low vibrations resulting in unequal wear patterns. Thus, unless the forces are balanced and properly distributed, wear and tear upon vibrated components may lead to early failure and increased maintenance. Therefore, there is a need in the art to provide a proper distribution of such vibrational energy and provide an improved vibrating wire screening machine

SUMMARY

In view of these needs, embodiments of the present subject matter may thus provide a vibrating screen separator machine comprising a frame bounding a first screening assembly, the first screening assembly forming a first sifting plane. The first screening assembly may include a mesh screen and a planar backing panel proximate the mesh screen, the backing panel having a plurality of perforations. The separator machine further comprises a material input slot on the frame and an un-sifted material output slot and a sifted material output slot on the frame where material travels from the material input slot into the screening assembly and where un-sifted material exits the frame through the un-sifted material output slot and sifted material exits the frame through the first sifted material output slot. The separator machine also includes a vibration mechanism supported by the frame and connected to the screening assembly, the vibration mechanism imparting vibrational energy to the screening assembly to sift material passing through the screening assembly.

Another embodiment of the present subject matter provides a screening assembly for a vibrating screen separator machine. The screening assembly includes a mesh screen and a planar backing panel proximate and underlying the mesh screen, the backing panel having a plurality of perforations. The screening assembly further includes one or more vibrating members extending longitudinally in a direction of material travel over the screening assembly, the one or more vibrating members securing the mesh screen and backing panel to a fastening member centrally located with respect to the mesh screen and backing panel. Opposing lateral sides of the mesh screen are inserted in a double bent, elongated hook strip, and a vibration dampening insert is positioned between the hook strip and underlying backing screen panel to protect the mesh screen and backing panel from wear.

A further embodiment of the present subject matter provides a vibrating screen separator machine having a frame bounding a first screening assembly, the first screening assembly forming a sifting plane set at a predetermined angle. The first screening assembly includes a mesh screen and a planar backing panel underlying the mesh screen, the backing panel having a plurality of perforations. The separator machine also includes a material input slot on the frame and a plurality of material output slots and a vibration mechanism supported by the frame and connected to the first screening assembly, the vibration mechanism imparting vibrational energy to the first screening assembly to sift material pass through the first screening assembly to the plurality of material output slots. Granularity of material passing to each of the plurality of material output slots may be a function of a fineness of the mesh screen and the perforations of the backing panel.

DETAILED DESCRIPTION

With reference to the figures, where like elements have been given like numerical designations to facilitate an understanding of the present subject matter, the various embodiments for backing screen panels for vibration screen separators are described.

The following description of the present subject matter is provided as an enabling teaching of the present subject matter and its best, currently-known embodiment. Those skilled in the art will recognize that many changes may be made to the embodiments described herein while still obtaining the beneficial results of the present subject matter. It will also be apparent that some of the desired benefits of the present subject matter may be obtained by selecting some of the features of the present subject matter without utilizing other features. Accordingly, those who work in the art will recognize that many modifications and adaptations of the present subject matter are possible and may even be desirable in certain circumstances and are part of the present subject matter. Thus, the following description is provided as illustrative of the principles of the present subject matter and not in limitation thereof. While the following exemplary discussion of embodiments of the present subject matter may be directed towards or references specific telecommunications systems, it is to be understood that the discussion is not intended to limit the scope of the present subject matter in any way and that the principles presented are equally applicable to other communications networks, systems and associated protocols.

Those skilled in the art will appreciate that many modifications to the exemplary embodiments described herein are possible without departing from the spirit and scope of the present subject matter. Thus, the description is not intended and should not be construed to be limited to the examples given but should be granted the full breadth of protection afforded by the appended claims and equivalents thereto. In addition, it is possible to use some of the features of the present subject matter without the corresponding use of the other features. Accordingly, the foregoing description of exemplary or illustrative embodiments is provided for the purpose of illustrating the principles of the present subject matter and not in limitation thereof and may include modification thereto and permutations thereof.

Figure 1:
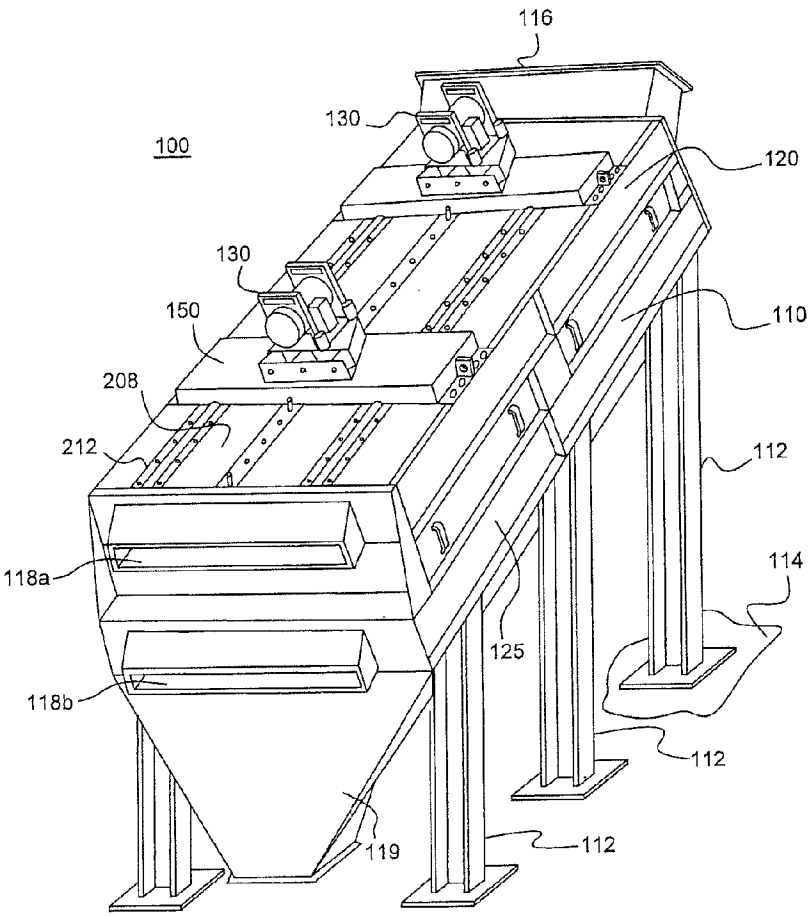
FIG. 1 is a perspective view of a vibration screen separator machine according to some embodiments of the present subject matter.
Figure 2:
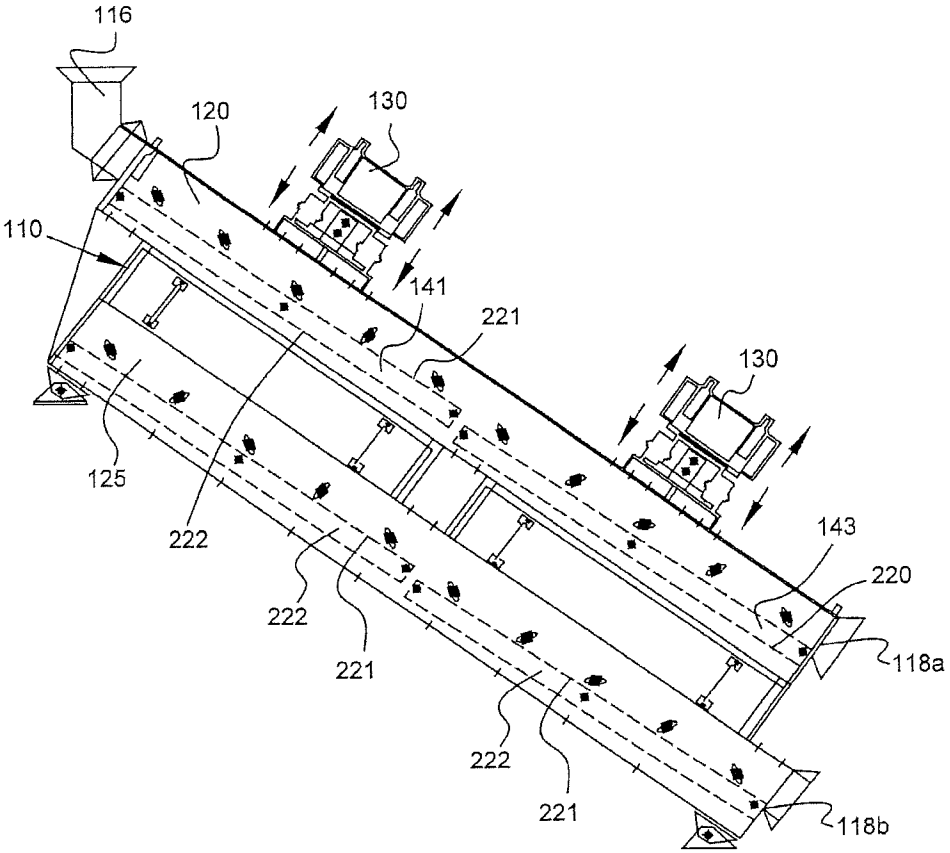
FIG. 2 is a side view of the vibration screen separator machine of FIG. 1.

FIG. 1 is a perspective view of a vibration screen separator machine. FIG. 2 is a side view of the vibration screen separator machine of FIG. 1. With reference to FIGS. 1 and 2, an exemplary screen separator machine 100 may be a single or plural deck separator machine having a rigid, elongated frame 110 bounding one or more sifting planes. In some embodiments, the frame 110 may be supported by a plurality of vertically upright stanchions 112 having a distal end thereof on a lower supporting surface 114. The lower supporting surface 114 may be any suitable planar surface. The stanchions 112 may be secured to the lower supporting surface 114 using any suitable affixing mechanism including, but not limited to, bolts, screws, foot plates, welds, and the like. An exemplary separator machine 100 may be canted or inclined at a predetermined angle, such as, but not limited to, 20, 25, 30, 35, 40 or more degrees to ensure that material entering the separator machine 100 from an input slot 116 or chute gravitationally flows towards one or more discharge slots or chutes 118*a*, 118*b*. Of course, any suitable inclination angle may be employed by embodiments of the present subject matter and the angles specifically provided herein should not limit the scope of the claims appended herewith. For example, in an alternative embodiment, the inclination angle may be, but is not limited to, 34.5 degrees.

While various embodiments of the present subject matter may provide a multi- or single-deck screen separator machine 100 to screen materials of different dimensions, the embodiment depicted in FIGS. 1 and 2 is a multi-deck machine 100 having a upper plurality of aligned, separating screens in an upper deck 120 and a lower plurality of aligned screens in a lower deck 125. Of course, additional or less decks of separating screens are envisioned for embodiments of the present subject matter. The separator machine 100 may include one or more vibration mechanisms 130 which are employed to impart vibrational energy to any number of screens in the machine 100. In the embodiment depicted in FIGS. 1 and 2, two vibration mechanisms 130 are provided, one for each respective screening area 141, 143; however, the claims appended herewith should not be so limited as it is envisioned that exemplary machines may include a single vibration mechanism with plural screening areas, one vibration mechanism with one screening area, three vibration mechanisms with three screening areas, and so forth. Exemplary vibration mechanisms 130 include, but are not limited to, rotary electric or hydraulic vibrators applying an unbalanced or vibrating force to the upper and/or lower decks 120, 125. In some embodiments, the vibration mechanisms 130 may be powered with three-phase alternating electric current and run at between 1500-3600 rpm. Exemplary vibration mechanisms 130 may be employed for each deck 120, 125 with or without conventional suspension systems to provide additional control of a sifting screen. The number of vibration mechanisms 130 and/or suspension systems may be combined and deployed in different configurations as desired by the application. As will be recognized by those skilled in the art, the specific configuration depends upon the number of machine sections and decks employed.

In the illustrated embodiment, a plurality of sequential screen systems may be employed in each of two decks 120, 125 disposed within the frame 110 to sift and separate material flowing through the separator machine 100. Material that does not drop through any of the screens in the upper deck 120 may be conveyed as desired through a first output chute 118*a*. Material that drops through the upper deck 120 but does not drop through the lower deck 125 may be conveyed through a second output chute 118*b*. Material that drops through both the upper and lower decks 120, 125 may collect in a hopper 119 disposed beneath the frame 110. In other embodiments of the present subject matter, the hopper 119 may be substituted with a third output chute for providing the finer grade material.

Exemplary vibration mechanisms 130 may be mounted on a transverse bridge 150 disposed on the top of the frame 110 and connected to the frame cover 208. In some embodiments, a vibration mechanism 130 may include a ruggedized electric, rotary vibrator having a casing in which an eccentrically weighted internal shaft rotates about an axis of rotation aligned with the direction of material travel. These eccentric weights may be adjustable so output force is varied. While not shown, the vibration mechanism may be provided with buffering or dampening components to provide quiet operation of the machine 100 and localize vibrations to only the respective sifting planes.

Figure 3:
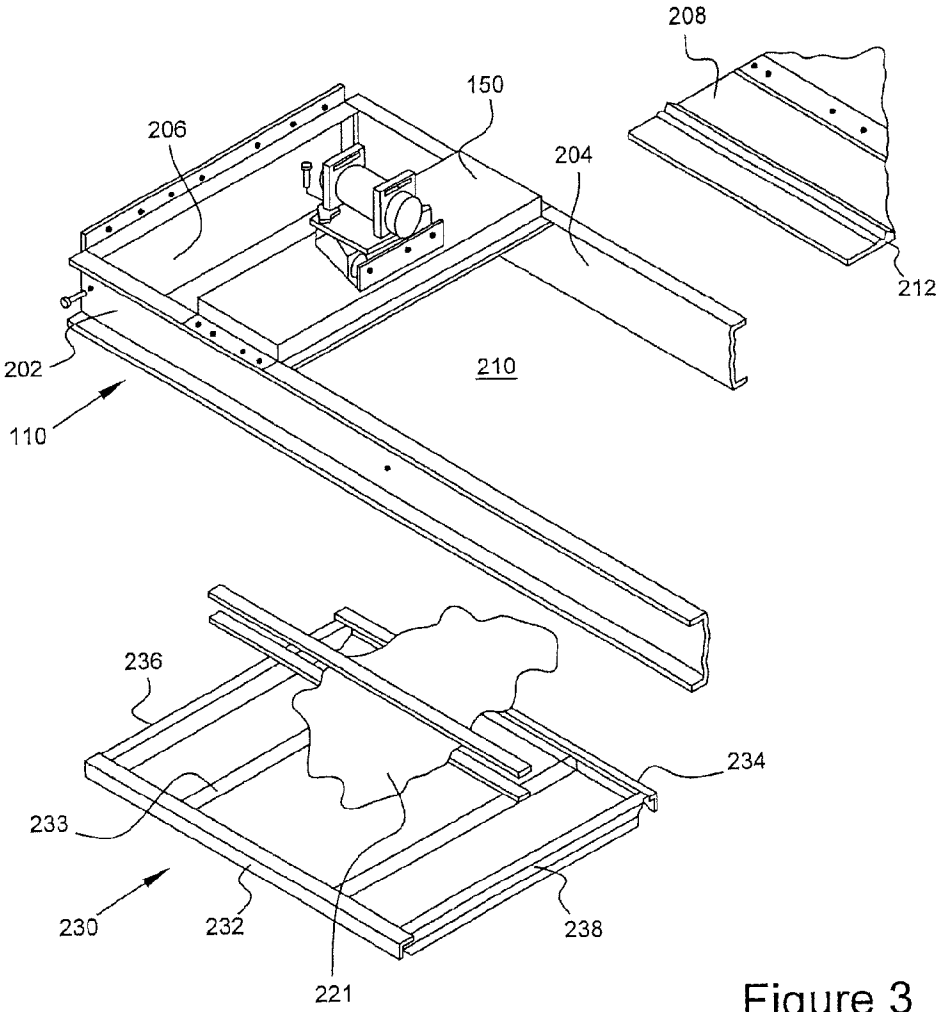
FIG. 3 is an illustration of a frame and associated screen of an exemplary vibration screen separator machine.

FIG. 3 is an illustration of a frame and associated screen of an exemplary vibration screen separator machine 100. With reference to FIGS. 1-3, an exemplary frame 110 may be substantially rectangular or another geometric form and may comprise, in a rectangular embodiment, a pair of longitudinal side members 202, 204 spaced apart by lateral members 206 to form a generally rectangular screen receptive region 210. A frame cover 208 may be positioned over the frame 110 and comprise one or more segments braced and/or secured by suitable cover braces 212 extending longitudinally along the top of the frame cover 208 and suitably fastened to the frame 110. The longitudinal and later frame members 202, 204, 206 bound a sifting plane 220 established by a substantially planar, tensioned metallic and/or cloth mesh screen 221. Positioned adjacent to and backing the mesh screen 221 is a substantially planar backing screen panel 222. While not shown, additional sifting planes comprising mesh screens and backing screen panels may also be disposed beneath the upper deck. In some embodiments, a subframe 230 may be fitted to the frame interior between longitudinal and lateral members 202, 204, 206. In the depicted embodiment, the subframe 230 is rectangular and similar in shape to the respective rectangular frame 110, however, the present subject matter should not be so limited as the subframe shape should substantially correspond to the respective frame shape, whether annular, parallel-piped, etc. The subframe 230 may thus ensure that the frame sides do not deform in response to mesh screen tensioning When the mesh screen 221 is tensioned, the subframe 230 resists frame deformation and ensures that the mesh screen 221 is uniformly tensioned. Exemplary subframes 230 may include lateral members 236, 238 spaced apart from longitudinal members 232, 234. Cross braces 233 may also be employed to further strengthen the subframe.

Figure 4:
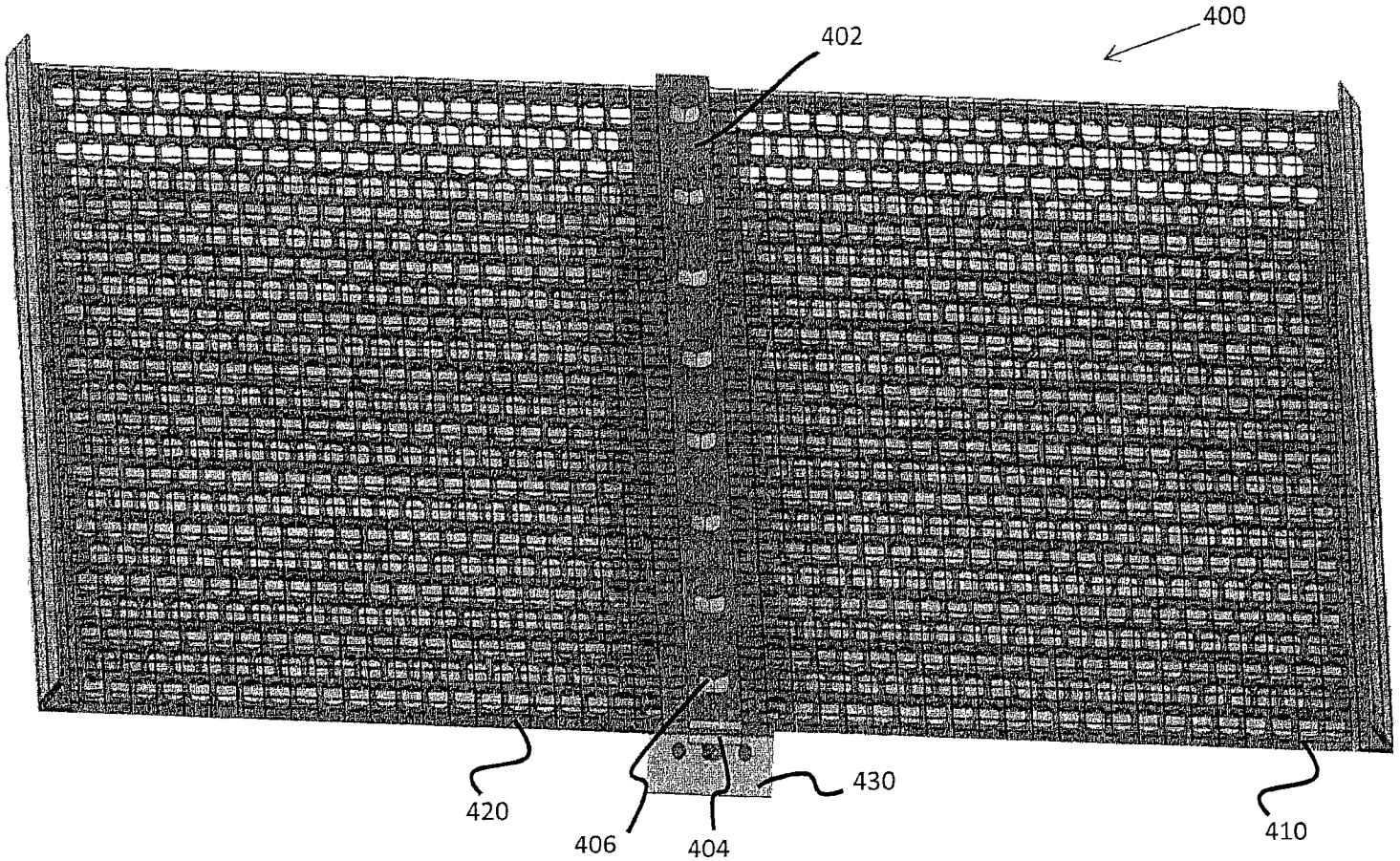
FIG. 4 is a perspective view of a screening assembly according to some embodiments of the present subject matter.
Figure 5:
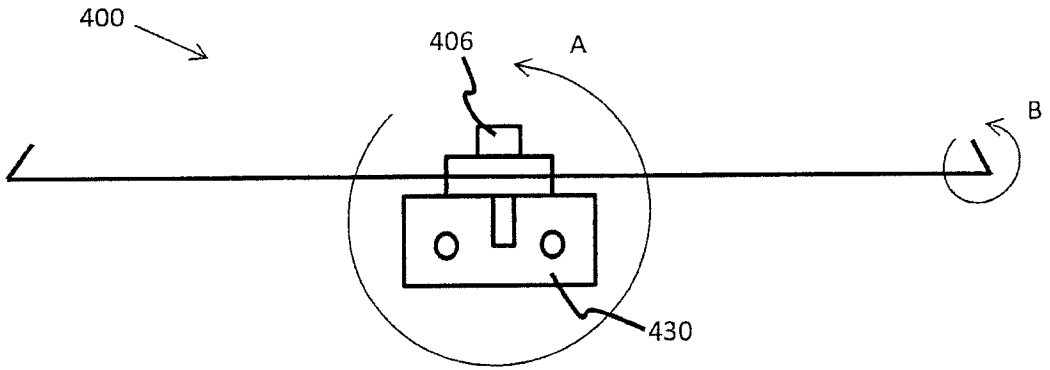
FIG. 5 is a side plan view of the screening assembly of FIG. 4.
Figure 6:
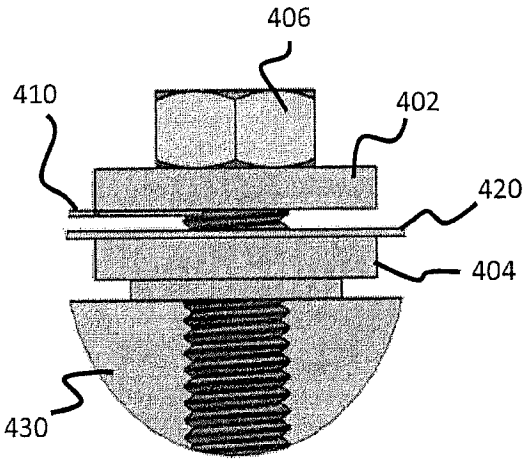
FIGS. 6, 7A and 7B are cross-sectional detail views of Sections A and B, respectively, of the screening assembly in FIG. 5.
Figure 7A:
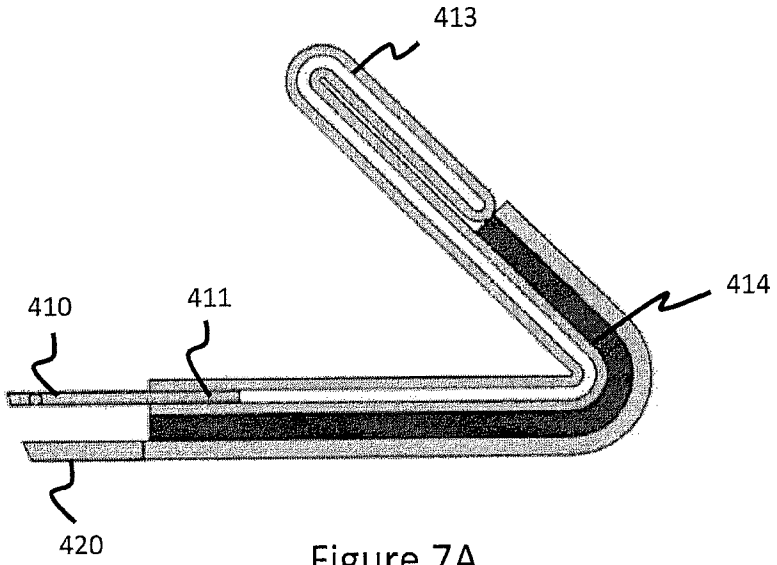
Figure 7B:
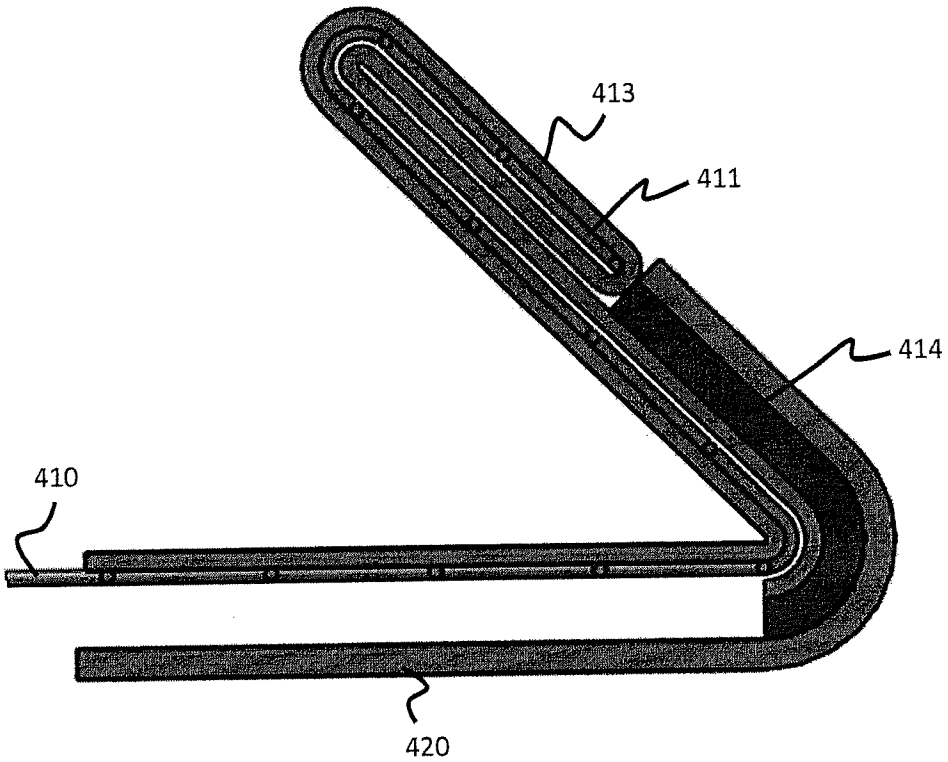

FIG. 4 is a perspective view of a screening assembly according to some embodiments of the present subject matter. FIG. 5 is a side plan view of the screening assembly of FIG. 4. FIGS. 6, 7A and 7B are cross-sectional detail views of Sections A and B, respectively, of the screening assembly in FIG. 5. With reference to FIGS. 4-7, a screening assembly 400 may include first and second elongated central vibrating strips 402, 404, each extending longitudinally in the direction of material travel. In some embodiments, the vibrating strips 402, 404 are substantially centered with respect to the mesh screen 410 and/or backing screen panel 420. The vibrating strips 402, 404 may generally comprise a pair of cooperating, generally rectangular strips that are secured to a centrally located member 430 or bolt-down bar and aligned together using suitable fasteners 406 such as, but not limited to, bolts, screws or other fasteners. The vibrating strips 402, 404 are directly vibrated to shake the mesh screen 410. Such a vibration may be transferred to the strips 402, 404 using a bracket and linkage (not shown) which are connected to a proximate vibration mechanism 130 located external of the frame. In further embodiments of the present subject matter having additional deck levels, additional linkages and brackets may be interconnected with the lower decks and screening assemblies to transfer vibrational energy to these respective deck levels. Thus, vibrations imparted from a vibration mechanism 130 may be provided directly to the vibrating strips 402, 404 and hence to the respective screening assembly(ies) 400. In additional embodiments of the present subject matter, buffering and dampening mechanisms may be employed to further isolate vibrations from other components of the machine 100.

Exemplary mesh screens 410 may be comprised of a resilient, planar wire cloth in some embodiments (e.g., having a fine porosity) or a planar wire mesh depending upon the size of the desired material to be screened. In the embodiment depicted in FIG. 4, a planar wire mesh 410 is illustrated to allow depiction of the underlying backing screen panel 420. Of course, finer wire meshes and/or cloths may be employed in embodiments of the present subject matter and such a depiction should not limit the scope of the claims appended herewith. Further, it is envisioned that different sized meshes or screens on opposing sides of the centrally located member 430 may be provided in embodiments of the present subject matter.

Figure 8:
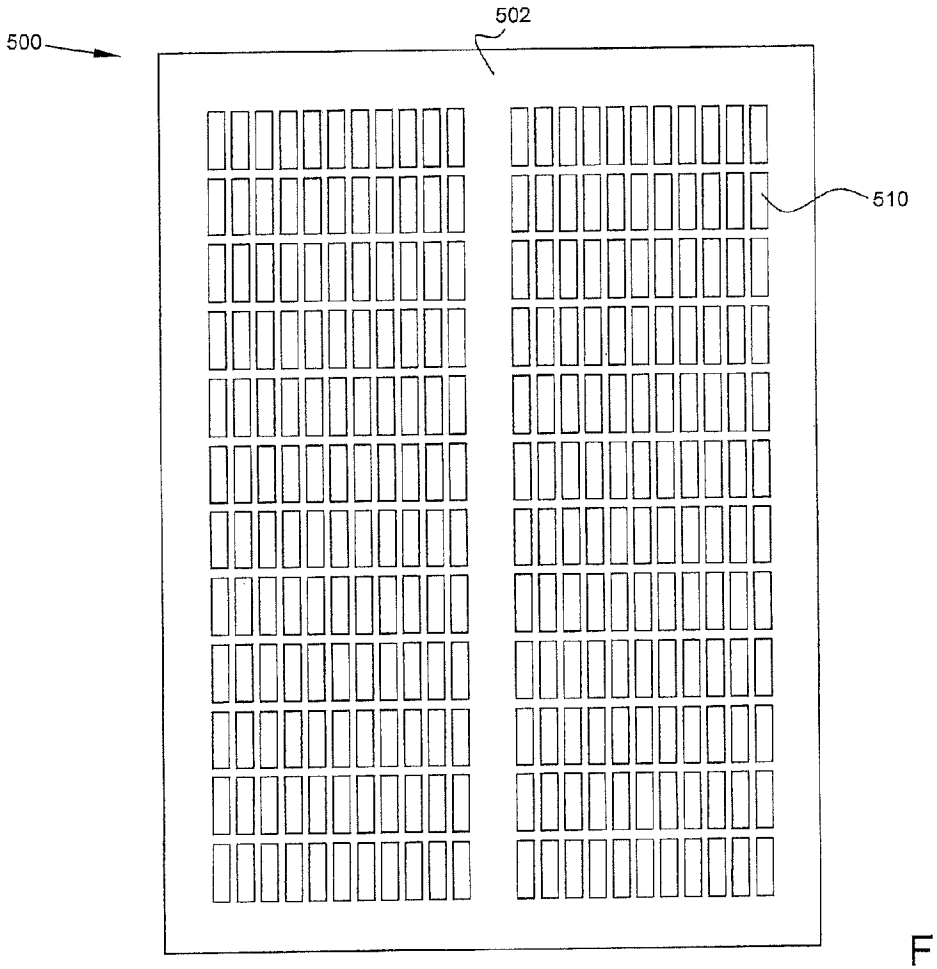
FIGS. 8-11 are top plan views of exemplary backing screen panels according to additional embodiments of the present subject matter.

As illustrated in FIGS. 4, 5 and 8, the outermost edges of the screen assembly 400 may be folded and/or crimped appropriately. In some embodiments, opposing elongated sides 411 of the mesh screen 410 may be partially inserted in a double bent, elongated hook strip 413 as illustrated in FIG. 7A. In other embodiments, opposing elongated sides 411 of the mesh screen 410 may be fully inserted in the double bent, elongated hook strip 413 and may follow the contours thereof as illustrated in FIG. 7B. In the embodiment illustrated in FIG. 7B, a better contact between the mesh screen 410 and backing screen panel 420 may be achieved. A temperature-resistant vibration dampening insert 414 such as, but not limited to, silicon tape, silicon strips, rubber tape, rubber strips, rubber inserts, and the like, may be provided as a buffer between the double bent, elongated hook strip 413 and the underlying backing screen panel 420 to protect against premature wear from metal-to-metal friction between the mesh screen 410 and panel 420. The dampening insert 414 and respective elongated side of the backing screen panel 420 may be bent in similar fashion as the elongated hook strip 413. In some embodiments of the present subject matter, an additional section of metal may be affixed to the backing screen panel 420 that is already bent in similar fashion as the elongated hook strip 413, rather than bending the outer edges of the backing screen panel 420.

The elongated and bent sides of the screening assembly 400 may be appropriately secured and/or buffered to the internal sides of the frame. Suitable buffering mechanisms include rubber and/or silicone strips, inserts and the like. In one embodiment, the screening assembly is provided with tensioning rails such that portions or all of the screening assembly 400 may be tensioned by an operator of the system. In embodiments of the present subject matter that involve sifting material having temperatures greater than 200 degrees Fahrenheit, suitable buffering mechanisms and dampening inserts may be formed from more resilient material such as metals or the like. In additional embodiments, the edges of exemplary screen assemblies and/or tensioning rails may contact a subframe such that tensioning forces applied to the assembly are distributed evenly into the assembly. Thus, exemplary screen assemblies 400 may extend between the inner sides of a frame 110 within a screen receptive region 210 (see FIG. 2).

Figure 9:
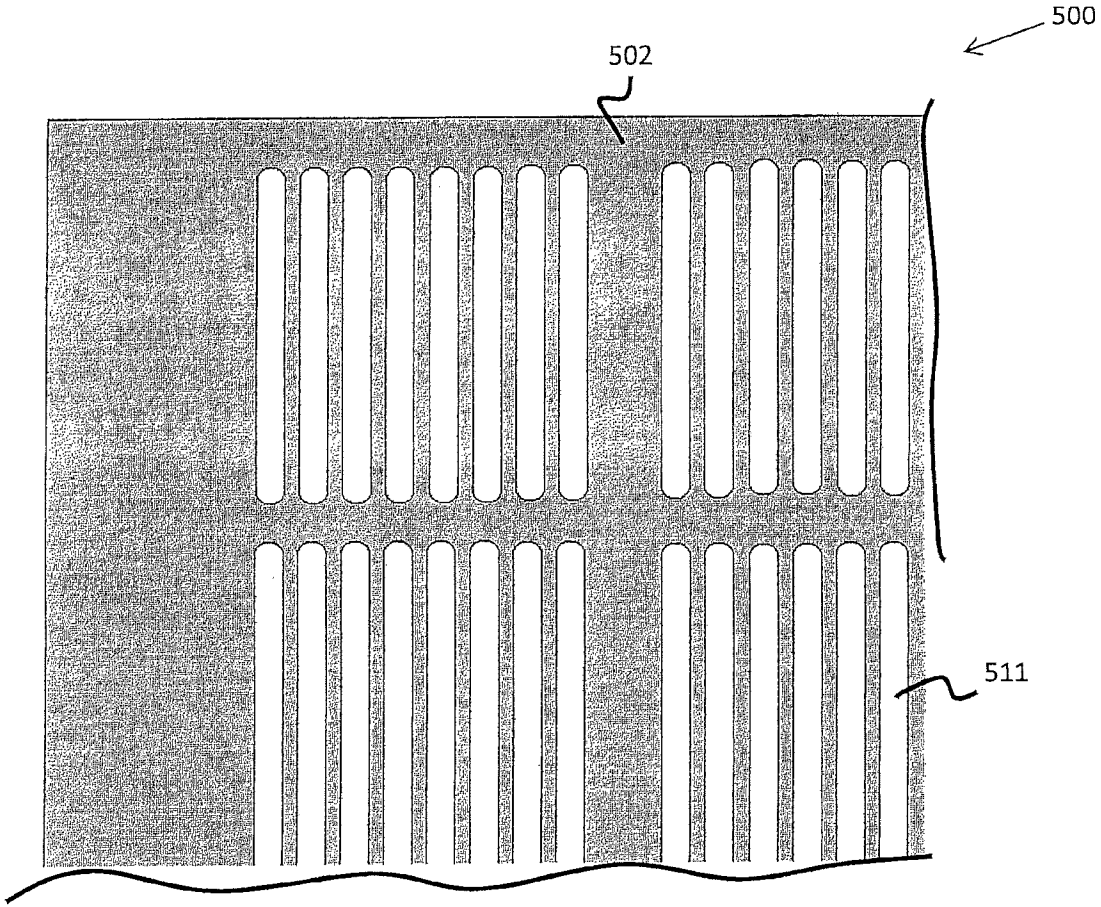
Figure 10:
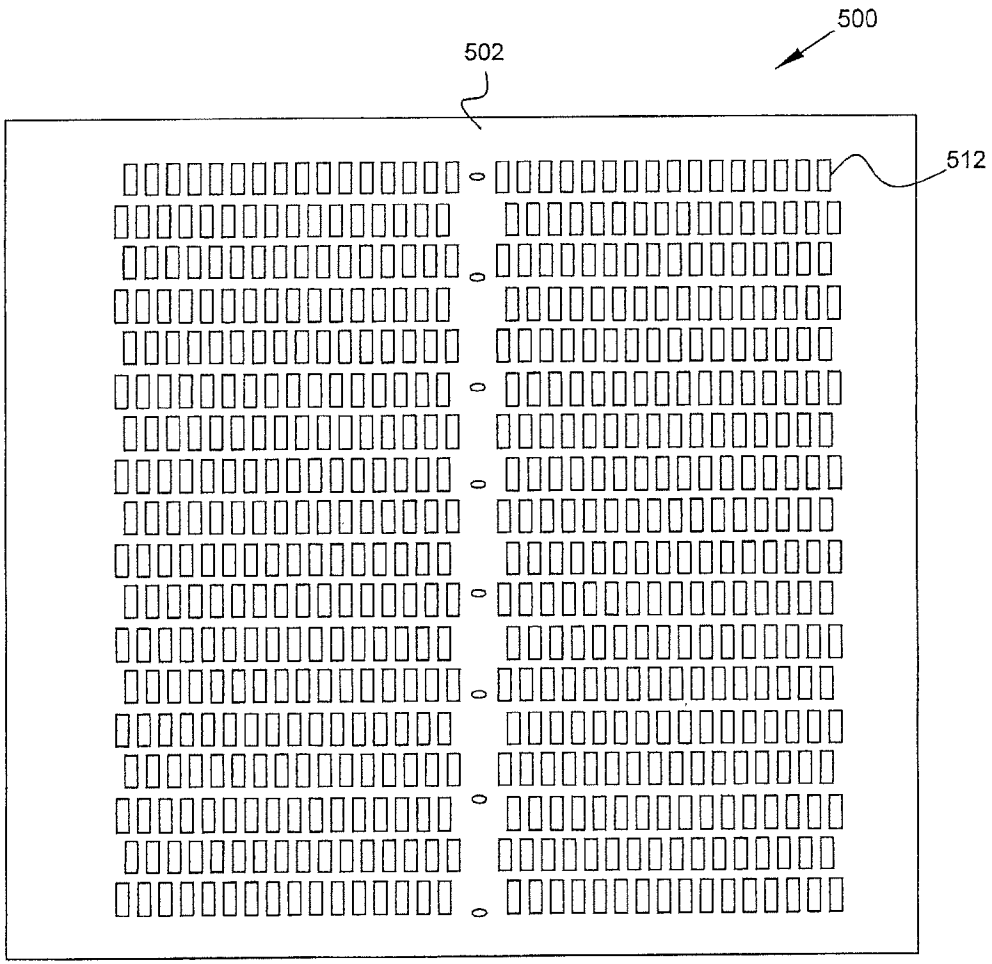
Figure 11:
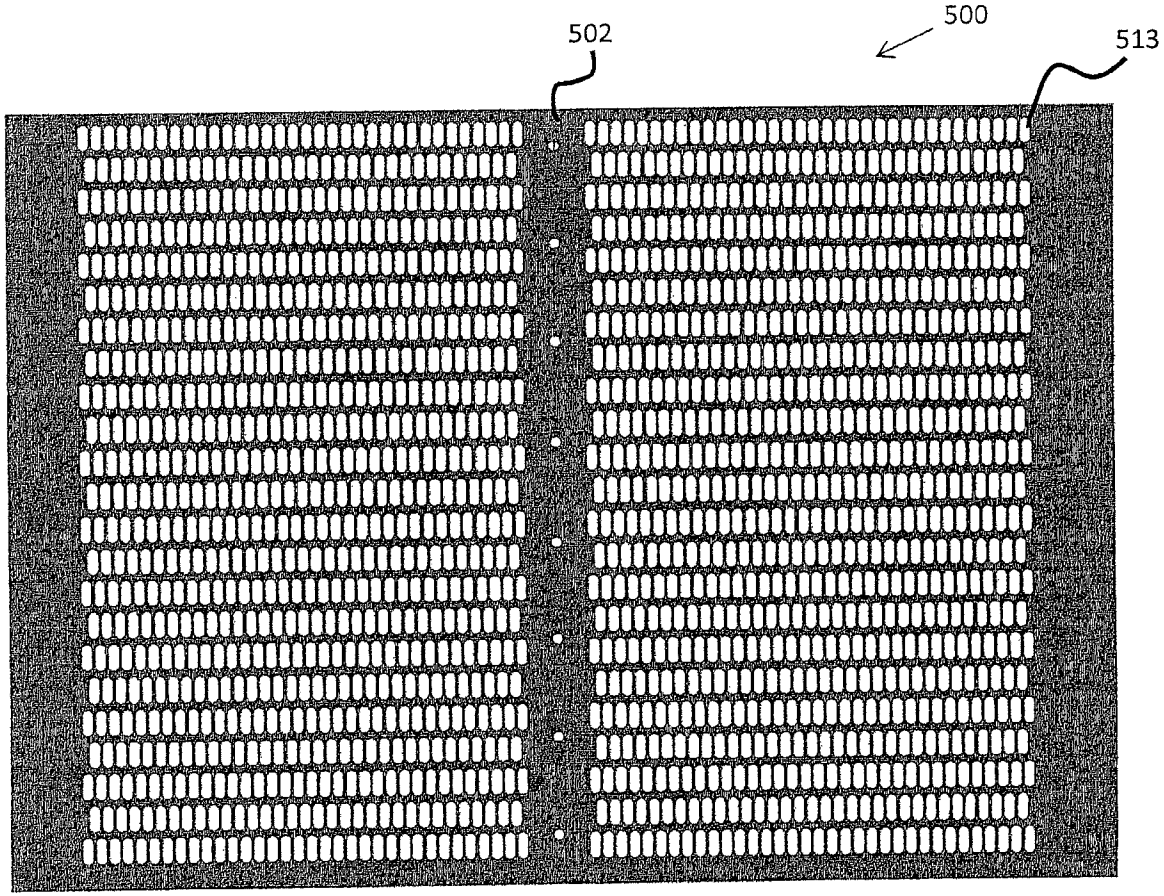

FIGS. 8-11 are top plan views of exemplary backing screen panels according to additional embodiments of the present subject matter. With reference to FIG. 8, one exemplary backing screen panel 500 may include a plurality of similarly shaped rectangular orifices or perforations 510 arranged in columns and rows along a plane formed by the panel 500. The panel 500 may also include a central portion 502 where appropriate vibrating strips and the like may be positioned to impart vibrational energy to a respective screening assembly. While the depicted perforations are rectangular in foam, the claimed subject matter should not be so limited as exemplary backing screen panels may include various types, locations, and numbers of perforations. For example, the perforations may be arranged in columns and rows but include a substantially rectangular form with curved edges 511 as depicted in FIG. 9. The perforations may also be arranged in rows but offset columns and include a rectangular (or otherwise) form 512 as depicted in FIG. 10. In yet a further embodiment, the perforations may be arranged in rows and offset columns and include an oblong 513, circular, or oval form as depicted in FIG. 11. In additional embodiments of the present subject matter the number, shape, type and location of the perforations 510, 511, 512, 513 may be a function of the proximate mesh screen and/or the open area or effective opening required. For example, for a screen plane set at a 35 degree inclination angle or slope, an effective opening for sifted material may be adjusted using any one or combination of the rpm of the vibration mechanism, size of the wire or cloth mesh screen, and shape number, type, size and/or location of perforations in the respective backing screen panel.

In some embodiments of the present subject matter an exemplary vibrating screen separator machine comprises a frame bounding a first screening assembly, the first screening assembly forming a first sifting plane. The first screening assembly includes a mesh screen and a planar backing panel proximate the mesh screen, the backing panel having a plurality of perforations. Exemplary mesh screens include, but are not limited to, a wire cloth screen or a wire mesh screen, the wire cloth screen having a finer degree of porosity than the wire mesh screen. In some embodiments, the planar backing panel may be a planar sheet of material and the plural perforations therein may be provided in an arrangement selected from the group consisting of rectangular, circular, oblong or oval perforations positioned in aligned rows and columns or positioned in aligned rows and offset columns. In some embodiments, the first sifting plane may be canted at an angle such as, but not limited to, approximately 20, 25, 30, 34.5, 35, 40, 45 degrees from a horizontal plane. The separator machine may also include a material input slot on the frame and an un-sifted material output slot and a sifted material output slot on the frame, where material travels from the material input slot into the screening assembly and where un-sifted material exits the frame through the un-sifted material output slot and sifted material exits the frame through the first sifted material output slot. The separator machine also includes a vibration mechanism supported by the frame and connected to the screening assembly, the vibration mechanism imparting vibrational energy to the screening assembly to sift material passing through the screening assembly. In another embodiment, the frame may further bound a second screening assembly, the second screening assembly comprising a mesh screen and a planar backing panel proximate the mesh screen, the backing panel having a plurality of perforations. This second screening assembly may be positioned on the first sifting plane and downstream of the first screening assembly or may be positioned on a second sifting plane parallel to the first sifting plane, the second screening assembly accepting sifted material passing through the first screening assembly. In such an embodiment, the material exiting the frame through the second sifted material output slot is substantially finer than material exiting the frame through the first sifted material output slot. In an additional embodiment, the screening assembly may further include one or more vibrating members extending longitudinally in a direction of material travel over the screening assembly, the one or more vibrating members securing the mesh screen and backing panel to a fastening member centrally located with respect to the mesh screen and backing panel and the one or more vibrating members are connected to the vibration mechanism. In such an embodiment, opposing lateral sides of the mesh screen may be inserted in a double bent, elongated hook strip, and a vibration dampening insert may be positioned between the hook strip and backing screen panel to protect the mesh screen and backing panel from wear.

Additional embodiments of the present subject matter may provide a screening assembly for a vibrating screen separator machine including a mesh screen, a planar backing panel proximate and underlying the mesh screen, the backing panel having a plurality of perforations, and one or more vibrating members extending longitudinally in a direction of material travel over the screening assembly, the one or more vibrating members securing the mesh screen and backing panel to a fastening member centrally located with respect to the mesh screen and backing panel. Opposing lateral sides of the mesh screen may be inserted in a double bent, elongated hook strip, and a vibration dampening insert may be positioned between the hook strip and underlying backing screen panel to protect the mesh screen and backing panel from wear. Exemplary dampening inserts include, but are not limited to, silicon tape, silicon strips, rubber tape, rubber strips, rubber inserts and combinations thereof. Further exemplary mesh screens include, but are not limited to, a wire cloth screen or a wire mesh screen, the wire cloth screen having a finer degree of porosity than the wire mesh screen. In some embodiments, the planar backing panel may be a planar sheet of material and the plural perforations therein may be provided in an arrangement selected from the group consisting of rectangular, circular, oblong or oval perforations positioned in aligned rows and columns or positioned in aligned rows and offset columns.

Various embodiments of the present subject matter may provide a vibrating screen separator machine having a frame bounding a first screening assembly, the first screening assembly forming a sifting plane set at a predetermined angle. The first screening assembly may include a mesh screen and a planar backing panel underlying the mesh screen, the backing panel having a plurality of perforations. The separator machine may also include a material input slot on the frame and a plurality of material output slots and a vibration mechanism supported by the frame and connected to the first screening assembly, the vibration mechanism imparting vibrational energy to the first screening assembly to sift material pass through the first screening assembly to the plurality of material output slots. Granularity of material passing to each of the plurality of material output slots may be a function of a fineness of the mesh screen and the perforations of the backing panel. Exemplary mesh screens include, but are not limited to, a wire cloth screen or a wire mesh screen, the wire cloth screen having a finer degree of porosity than the wire mesh screen. In some embodiments, the planar backing panel may be a planar sheet of material and the plural perforations therein may be provided in an arrangement selected from the group consisting of rectangular, circular, oblong or oval perforations positioned in aligned rows and columns or positioned in aligned rows and offset columns. In additional embodiments, the granularity of material passing to each of the plurality of material output slots may further be a function of the predetermined angle of the sifting plane and amplitude of vibrational energy provided to the first screening assembly. In a further embodiment, the frame may further bound a second screening assembly, the second screening assembly comprising a mesh screen and a planar backing panel proximate the mesh screen, the backing panel having a plurality of perforations. In one such embodiment, the second screening assembly may be positioned on the first sifting plane and downstream of the first screening assembly where granularity of material passing to each of the plurality of material output slots is a function of a fineness of the mesh screen and the perforations of the backing panel for the second screening assembly. In another such embodiment, the second screening assembly may be positioned on a second sifting plane parallel to the first sifting plane, the second screening assembly accepting sifted material passing through the first screening assembly and where granularity of material passing to each of the plurality of material output slots is a function of a fineness of the mesh screen and the perforations of the backing panel for the second screening assembly.

While this description may contain many specifics, these should not be construed as limitations on the scope thereof, but rather as descriptions of features that may be specific to particular embodiments. Certain features that have been heretofore described in the context of separate embodiments may also be implemented in combination in a single embodiment. Conversely, various features that are described in the context of a single embodiment may also be implemented in multiple embodiments separately or in any suitable subcombination. Moreover, although features may be described above as acting in certain combinations and may even be initially claimed as such, one or more features from a claimed combination may in some cases be excised from the combination, and the claimed combination may be directed to a subcombination or variation of a subcombination.

Similarly, while operations are depicted in the drawings or figures in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems may generally be integrated together in a single software product or packaged into multiple software products.

As shown by the various configurations and embodiments illustrated in FIGS. 1-11, various embodiments for backing screen panels for vibration screen separators have been described.

While preferred embodiments of the present subject matter have been described, it is to be understood that the embodiments described are illustrative only and that the scope of the invention is to be defined solely by the appended claims when accorded a full range of equivalence, many variations and modifications naturally occurring to those of skill in the art from a perusal hereof.

I claim:

1. A vibrating screen separator machine comprising:

a frame bounding a first screening assembly, the first screening assembly forming a first sifting plane and comprising:

a mesh screen, and a planar backing panel proximate the mesh screen, the backing panel having a plurality of perforations;

a material input slot on the frame;

an un-sifted material output slot and a sifted material output slot on the frame, wherein material travels from the material input slot into the screening assembly and wherein un-sifted material exits the frame through the un-sifted material output slot and sifted material exits the frame through the first sifted material output slot;

a vibration mechanism supported by the frame and connected to the screening assembly, the vibration mechanism imparting vibrational energy to the screening assembly to sift material passing through the screening assembly; and one or more vibrating members extending longitudinally in a direction of material travel over the first screening assembly, the one or more vibrating members securing the mesh screen and backing panel to a fastening member centrally located with respect to the mesh screen and backing panel and the one or more vibrating members are connected to the vibration mechanism, with opposing lateral sides of the mesh screen being inserted in a double bent, elongated hook strip, and including a vibration dampening insert positioned between the hook strip and the backing screen panel so as to protect the mesh screen and backing panel from wear.

2. The vibrating screen separator machine of claim 1 wherein the frame further bounds a second screening assembly, the second screening assembly comprising a mesh screen and a planar backing panel proximate the mesh screen, the backing panel having a plurality of perforations.

3. The vibrating screen separator machine of claim 2 wherein the second screening assembly is positioned on the first sifting plane and downstream of the first screening assembly.

4. The vibrating screen separator machine of claim 2 wherein the second screening assembly is positioned on a second sifting plane parallel to the first sifting plane, the second screening assembly accepting sifted material passing through the first screening assembly.

5. The vibrating screen separator machine of claim 4 further comprising a second sifted material output slot wherein material exiting the frame through the second sifted material output slot is substantially finer than material exiting the frame through the first sifted material output slot.

6. The vibrating screen separator machine of claim 1 wherein the mesh screen is a wire cloth screen or a wire mesh screen, the wire cloth screen having a finer degree of porosity than the wire mesh screen.

7. The vibrating screen separator machine of claim 1 wherein the planar backing panel further comprises a planar sheet of material and wherein the plural perforations are provided in an arrangement selected from the group consisting of rectangular, circular, oblong or oval perforations positioned in aligned rows and columns or positioned in aligned rows and offset columns.

8. The vibrating screen separator machine of claim 1 wherein the first sifting plane is canted at an angle selected from the group consisting of approximately 20, 25, 30, 34.5, 35, 40, 45 degrees from a horizontal plane.

9. A screening assembly for a vibrating screen separator machine comprising:

a mesh screen;

a planar backing panel proximate and underlying the mesh screen, the backing panel having a plurality of perforations; and one or more vibrating members extending longitudinally in a direction of material travel over the screening assembly, the one or more vibrating members securing the mesh screen and backing panel to a fastening member centrally located with respect to the mesh screen and backing panel, wherein opposing lateral sides of the mesh screen are inserted in a double bent, elongated hook strip, and wherein a vibration dampening insert is positioned between the hook strip and underlying backing screen panel to protect the mesh screen and backing panel from wear.

10. The screening assembly of claim 9 wherein the dampening insert is selected from the group consisting of silicon tape, silicon strips, rubber tape, rubber strips, rubber inserts and combinations thereof.

11. The screening assembly of claim 9 wherein the mesh screen is a wire cloth screen or a wire mesh screen, the wire cloth screen having a finer degree of porosity than the wire mesh screen.

12. The screening assembly of claim 9 wherein the planar backing panel further comprises a planar sheet of material and wherein the plural perforations are provided in an arrangement selected from the group consisting of rectangular, circular, oblong or oval perforations positioned in aligned rows and columns or positioned in aligned rows and offset columns.

13. A vibrating screen separator machine comprising:

a frame bounding a first screening assembly, the first screening assembly forming a sifting plane set at a predetermined angle, the first screening assembly comprising:

a mesh screen, and a planar backing panel underlying the mesh screen, the backing panel having a plurality of perforations;

a material input slot on the frame and a plurality of material output slots; and a vibration mechanism supported by the frame and connected to the first screening assembly, the vibration mechanism imparting vibrational energy to the first screening assembly to sift material pass through the first screening assembly to the plurality of material output slots, wherein granularity of material passing to each of the plurality of material output slots is a function of a fineness of the mesh screen and the perforations of the backing panel; and one or more vibrating members extending longitudinally in a direction of material travel over the first screening assembly, the one or more vibrating members securing the mesh screen and backing panel to a fastening member centrally located with respect to the mesh screen and backing panel and the one or more vibrating members are connected to the vibration mechanism, with opposing lateral sides of the mesh screen being inserted in a double bent, elongated hook strip, and including a vibration dampening insert positioned between the hook strip and the backing screen panel so as to protect the mesh screen and backing panel from wear.

14. The vibrating screen separator machine of claim 13 wherein the mesh screen is a wire cloth screen or a wire mesh screen, the wire cloth screen having a finer degree of porosity than the wire mesh screen.

15. The vibrating screen separator machine of claim 13 wherein the planar backing panel further comprises a planar sheet of material and wherein the plural perforations are provided in an arrangement selected from the group consisting of rectangular, circular, oblong or oval perforations positioned in aligned rows and columns or positioned in aligned rows and offset columns.

16. The vibrating screen separator machine of claim 13 wherein the granularity of material passing to each of the plurality of material output slots is further a function of the predetermined angle of the sifting plane and amplitude of vibrational energy provided to the first screening assembly.

17. The vibrating screen separator machine of claim 13 wherein the frame further bounds a second screening assembly, the second screening assembly comprising a mesh screen and a planar backing panel proximate the mesh screen, the backing panel having a plurality of perforations.

18. The vibrating screen separator machine of claim 17 wherein the second screening assembly is positioned on the first sifting plane and downstream of the first screening assembly and wherein granularity of material passing to each of the plurality of material output slots is a function of a fineness of the mesh screen and the perforations of the backing panel for the second screening assembly.

19. The vibrating screen separator machine of claim 17 wherein the second screening assembly is positioned on a second sifting plane parallel to the first sifting plane, the second screening assembly accepting sifted material passing through the first screening assembly, and wherein granularity of material passing to each of the plurality of material output slots is a function of a fineness of the mesh screen and the perforations of the backing panel for the second screening assembly.

* * * * *